United States Patent [19]

Székács

[11] Patent Number: 4,654,758

[45] Date of Patent: Mar. 31, 1987

[54] HEADLAMP

[75] Inventor: György Székács, Budapest, Hungary

[73] Assignee: Tungsram Rt., Budapest, Hungary

[21] Appl. No.: 773,147

[22] Filed: Sep. 6, 1985

[30] Foreign Application Priority Data

Sep. 21, 1984 [HU] Hungary ..... 3569

[51] Int. Cl.[4] ..... F21V 7/00

[52] U.S. Cl. ..... 362/61; 362/297; 362/302

[58] Field of Search ..... 362/61, 80, 297, 302, 362/303, 305

[56] References Cited

U.S. PATENT DOCUMENTS

| | | | |
|---|---|---|---|
| 3,494,693 | 2/1970 | Elmer | 362/302 X |
| 4,420,800 | 12/1983 | Van Horn | 362/297 |
| 4,420,801 | 12/1983 | Reiling et al. | 362/297 |

FOREIGN PATENT DOCUMENTS

| | | | |
|---|---|---|---|
| 1167773 | 4/1964 | Fed. Rep. of Germany | 362/302 |
| 1058232 | 11/1953 | France | 362/302 |
| 1321999 | 2/1963 | France | 362/305 |

*Primary Examiner*—Carlton R. Croyle
*Assistant Examiner*—Theodore Olds
*Attorney, Agent, or Firm*—Gabriel P. Katona

[57] ABSTRACT

The invention concerns a headlamp, the envelope of which is constituted internally by at least one concave reflecting surface, preferably by paraboloid-shape and spherical surfaces, and having a light-emitting element in, or near, the focus of the main reflecting surface and mounted on the current conducting support, and the envelope being shut-up by a transparent cover plate. The essence of the invention consists of having a convex mirror located between the light-emitting element and the cover plate, with its reflecting surface facing the light-emitting element and the concave reflecting surfaces. The surface of the convex mirror is preferably of the shape of a hyperboloid of rotation.

1 Claim, 1 Drawing Figure

HEADLAMP

Figure 1:
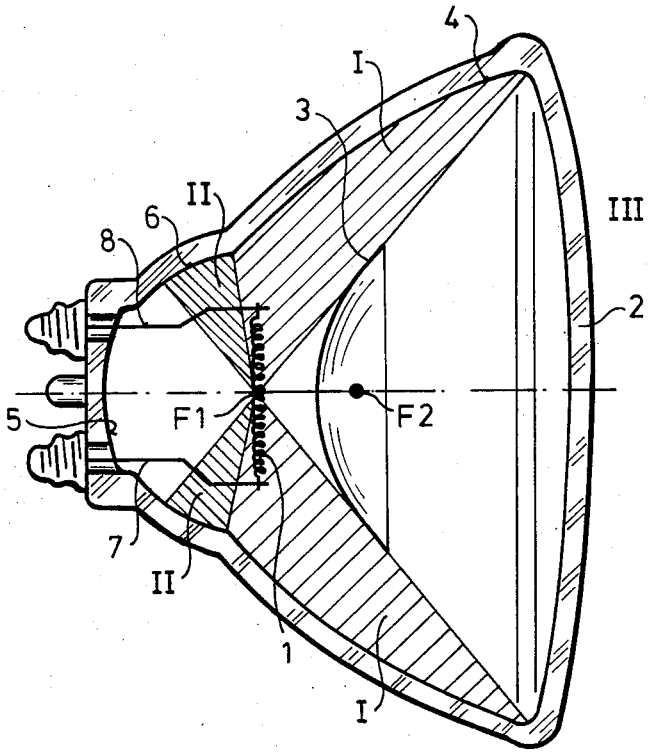

The invention relates to a headlamp comprising an envelope constituted internally by one or more concave reflecting surfaces, preferably having the shape of a paraboloid of rotation and of a sphere, and a light-emitting element arranged in or near the focus of the main reflecting surface and mounted on the current conducting supports, and said envelope being shut off by a transparent cover plate.

As is known, the type of headlamp, commonly called PAR lamp, made of pressed hand glass provided with an envelope having the shape of a paraboloid of rotation and being aluminized at its inside, combines in one unit the favourable properties of the lamp body. The parabolic reflecting envelope is shut up by a cover plate made of glass showing with a pressed-in pattern. The pattern is essential for obtaining the desired shape of the light beam. Depending on the pattern of the cover plate, the beam may be of the spot or flood type. The width of the light beam is usually characterized by the angle pertaining to the half value of maximum light intensity. This angle is typically 12° to 15° for a "spot" lamp and 35° to 40° for a "flood" lamp. The austerity compained launched recently to achieve savings in energy consumption has led to the supervision of energy requirements of PAR lamps. Developments have been directed to the exploration of methods to reduce the quantity of light radiated outside the region characterized by the half-value angle, by deflecting some portion of this light into the useful beam, i.e. into the useful region defined by said half-value angle. Several such attempts have become known. In the West-German patent specification DE No. 3 125 168 a floodlamp has been described where the reflecting surfaces are composed of paraboloid-shape and spherical parts. The focus of the paraboloid and that of the sphere coincide. The rear light rays not primarily reflected onto the parabolic mirror are reflected into the focus of the spherical mirror arranged in the collar section of the lamp, the light-emitting element being located in the centre of said spherical mirror, so as the deflect these rearwards emitted light rays into the useful light beam secondary reflection. In that case, however, the central portion of the divergent light emitted by the lamp, i.e. portion of the beam not directed toward the paraboloid mirror is left unutilized.

In another arrangement described in West-German specification DE No. 5 150 195 attempt is made to utilize the central portion of the divergent beam of the light-emitting element, not radiated in the direction of the paraboloid mirror by rendering the beam convergent through a concentric system of prisms arranged over the inner surface of the cover plate. Though here the light rays radiated in forward direction are collected by the system of concentrically arranged prisms, an undesirable distorting effect on the light distribution is exerted on the convergent primary light beam reflected by the paraboloid mirror.

Aim of the present invention is to provide for an arrangement by means of which the central divergent light directed in forward direction is rendered convergent in such a way that the primary light beam reflected by the main reflecting surface remains unaffected.

According to the invention, the set aim is achieved by placing a light deflecting convex mirror between the light-emitting element and cover plate, by which the divergent light beam radiating from the light-emitting element is prejected onto a concave reflecting surface.

Correspondingly, the present invention is a headlamp, the envelope of which is constituted by one or more internally concave reflecting surfaces, preferably having the shape of a paraboloid of rotation and a sphere, and having a light-emitting element arranged in, or near, the focus of the main reflecting surface and mounted on the current conducting supports, and where the envelope is provided with a transparent cover plate, and a convex mirror is placed between the light-emitting element and cover plate, with its reflecting side facing the light-emitting element one or more concave reflecting surfaces.

By means of the arrangement according to the invention, the efficiency of the headlamp can be improved by rendering convergent the light beam otherwise spread over a wide spatial angle. Thus, the same intensity of illumination can be achieved with a reduced power input, resulting in an energy sparing design.

Additional measures can be taken to improve further convergence of the light beam. Thus, the diameter of the convex mirror can be made equal to, or differing not more than by $\pm\frac{1}{8}$ diameter from the diameter of the smaller aperture of the paraboloid-shape main reflecting surface. Further, if the convex mirror is given the shape of a hyperboloid of rotation the light of the headlamp can be directed in such a way as if it had been emitted by a pinhole source of light. The convex mirror should preferably be arranged coaxially with the concave reflecting surfaces, but at least with the paraboloid-shaped main reflecting surface. To improve the divertibility of the light beam, the most favourable arrangement of the hyperboloid-shaped convex mirror is to make one focus of the convex mirror coincide at least with the focus of the paraboloid-shaped main reflecting surface.

According to experience, the most effective way to concentrate light is to place the convex mirror at a distance equal to $\frac{1}{3}$ of the spacing between the light-emitting element and the cover plate, said distance being measured from the former.

The optimum focussing properties have been found with the PAR 38 type headlights if the distance between the two focuses of the convex mirror is chosen so as not to exceed the length of the light-emitting element, but to be at least $\frac{1}{3}$ of that length.

The arrangement can be considered optimal where the end points of the diameters of the hyperboloid-shaped convex mirror lie on the straight lines connecting the function points of the paraboloid-shaped main reflecting surface and cover plate with the focus of the main reflecting surface, while of the diameter of the convex mirror has a length equal to that of the diameter of the smaller aperture of the main reflecting surface. In this case, all divergent light rays are reflected to the main reflecting surface, but all parallel light rays pass unobstructed the cover plate.

Our invention will now be presented on an embodiment in a more detailed way with reference to the attached drawings, wherein:

FIG. 1 shows an embodiment of the headlamp being an example provided with reflecting surfaces having the shapes of a paraboloid of rotation and of a sphere and a hyperboloid of rotation convex mirror.

The envelope of the headlamp illustrated in the figure is constituted internally by a reflecting surface 4 having the shape of a paraboloid of rotation, and being the main reflecting surface, further by a spherical reflecting surface 6, as well as by a reflecting surface 5 having also the shape of a paraboloid of rotation. The envelope is sealed up on its front side by a cover plate 2. A light-emitting element 1, e.g. a helical tungsten coil, is attached to current conducting supports 7 and 8. At a distance equal to $\frac{1}{3}$ of the spacing between the light-emitting element 1 and the cover plate 2, measured from the former, a convex mirror 3 having the shape of a hyperboloid of rotation is arranged coaxially with the reflecting surfaces 4,5 and 6. In the arrangement shown, the focuses of the reflecting surfaces 4, 5 and 6 and the outer focus F1 of the convex mirror 3 coincide. The length of the diameter D of the convex mirror 3 is equal to the length of the diameter of the smaller aperture of the paraboloid-shape reflecting surface 4, and the end points of the diameters D of the hyperboloid shape convex mirror 3 lie on the straight lines connecting the junction points of the reflecting surface 4 and the cover plate 2. The distance between the focuses F1 and F2 of the hyperboloid-shape convex mirror 3 is about half of the length of the helical tungsten coil serving as the light-emitting element 1. The center of the helical tungsten coil is in the focus F1, and the light emitted by it gets primarily from angle section I to the paraboloid-shape reflecting surface 4, from where it is reflected in the form of a convergent light beam. From angle section II, the light gets to the spherical reflecting surface 6, from where it is reflected into the focus F1, then after a secondary reflection from the reflecting surface 4 also this portion of the light joins the convergent light beam. Effect to the rear paraboloid-shape reflecting surface 5 can be neglected beside the effect of the others.

In the absence of a convex mirror 3, the light radiating in the relating wide angle section III would leave the headlamp in the form of a divergent light beam. The hyperboloid-shape convex mirror 3, however, stands in the way of the light rays in angle section III, causing thereby the rays to get reflected from its surface to the reflecting surface 4, by which these rays are rendered convergent in a way similar to that described for angle section I. These light rays are reflected by the reflecting surface 4 as if they had been emitted from a virtual point, i.e. from the focus F2.

I claim:

1. A headlamp comprising an envelope constituted internally by a paraboloid of rotation and spherical shaped concave reflecting surfaces, a light emitting element arranged substantially in the focal point of a paraboloid shaped main reflecting surface and mounted on current conducting supports, and a transparent cover plate closing said envelope, wherein a convex mirror is located between said light emitting element and said cover plate and arranged with its reflecting surface facing said light emitting element and said concave reflecting surfaces, the length of the diameter of said convex mirror being equal to or differing by not more than by $\pm\frac{1}{3}$ of the length of the diameter of the of the smaller aperture of said main reflecting surface from said diagonal straight lines drawn between the junction circle between the main reflecting surface and the cover plate, and the focal point of the main reflecting surface.

* * * * *